US005168309A

United States Patent [19]

Adachi et al.

[11] Patent Number: 5,168,309

[45] Date of Patent: Dec. 1, 1992

[54] IMAGE FORMING APPARATUS HAVING A CHARGING MEMBER AND A CLEANING MEMBER AND A PROCESS CARTRIDGE DETACHABLY MOUNTABLE TO SAME

[75] Inventors: Hiroyuki Adachi, Tokyo; Noribumi Koitabashi, Yokohama, both of Japan

[73] Assignee: Canon Kabushiki Kaisha, Japan

[21] Appl. No.: 690,323

[22] Filed: Apr. 26, 1991

Related U.S. Application Data

[63] Continuation of Ser. No. 251,237, Sep. 30, 1988, abandoned.

[30] Foreign Application Priority Data

Oct. 5, 1987 [JP] Japan ..... 62-251295
Oct. 5, 1987 [JP] Japan ..... 62-251296

[51] Int. Cl.[5] ..... G03G 15/02; G03G 21/00
[52] U.S. Cl. ..... 355/219; 355/299
[58] Field of Search ..... 355/200, 219, 296, 299

[56] References Cited

U.S. PATENT DOCUMENTS

| | | | |
|---|---|---|---|
| 2,892,973 | 6/1959 | Straughan | 355/219 X |
| 3,936,183 | 2/1976 | Sadamatsu | 355/299 |
| 3,973,845 | 8/1976 | Lindblad et al. | 355/299 |
| 4,026,648 | 5/1977 | Takahashi | 355/299 |
| 4,264,191 | 4/1981 | Gerbasi et al. | 355/299 |
| 4,387,980 | 6/1983 | Ueno et al. | 355/219 |
| 4,469,434 | 9/1984 | Yamazaki et al. | 355/299 |
| 4,527,887 | 7/1985 | Vineski | 355/299 |
| 4,540,268 | 9/1985 | Toyono et al. | 355/210 |
| 4,547,060 | 10/1985 | Lindblad | 355/219 |
| 4,706,320 | 11/1987 | Swift | 355/219 |

FOREIGN PATENT DOCUMENTS

| | | | |
|---|---|---|---|
| 58-79277 | 5/1983 | Japan . | |
| 60-147756 | 8/1985 | Japan | 355/219 |
| 61-140972 | 6/1986 | Japan | 355/219 |
| 62-175780 | 8/1987 | Japan . | |
| 62-175781 | 8/1987 | Japan . | |

*Primary Examiner*—Fred L. Braun
*Attorney, Agent, or Firm*—Fitzpatrick, Cella, Harper & Scinto

[57] ABSTRACT

An image forming apparatus includes a cleaning blade for cleaning a photosensitive member and a contact charging blade for charging the photosensitive member. The contact charging blade is contacted to the photosensitive member with a frictional coefficient which is smaller than the frictional coefficient at which the cleaning blade is contacted to the photosensitive member. The photosensitive member and the blades are protected from wearing and damage even if the contact charging blade is contacted to such a portion of the photosensitive member which is free from residual matter due to the function of the cleaning blade. In addition, the service life of the contact charging blade can be expanded to be substantially equal to that of the cleaning blade, and therefore, the present invention is particularly effective when both of the blades are provided in a process cartridge detachably mountable into a main assembly of the apparatus.

44 Claims, 5 Drawing Sheets

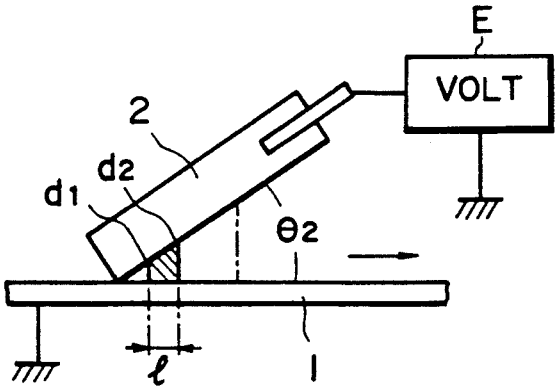
FIG. 8A
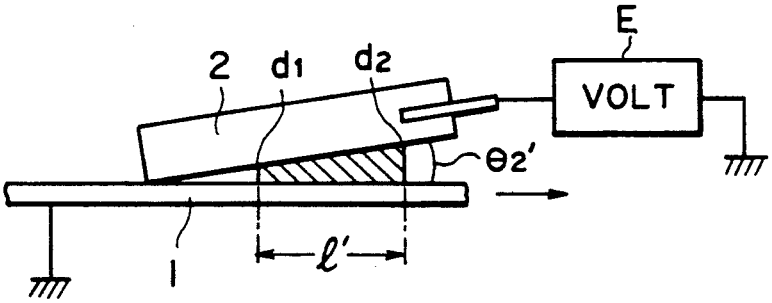
FIG. 8B
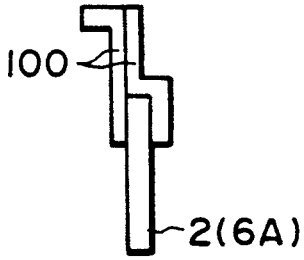
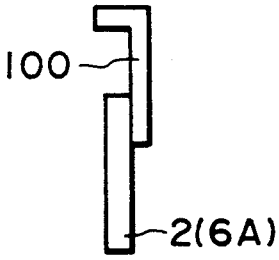
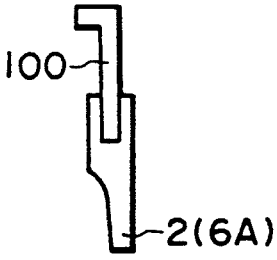
FIG. 9A FIG. 9B FIG. 9C
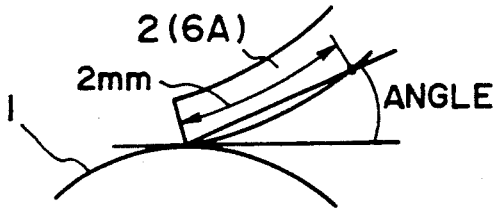
FIG. 10

IMAGE FORMING APPARATUS HAVING A CHARGING MEMBER AND A CLEANING MEMBER AND A PROCESS CARTRIDGE DETACHABLY MOUNTABLE TO SAME

This application is a continuation of application Ser. No. 07/251,237 filed Sep. 20, 1988, now abandoned.

FIELD OF THE INVENTION AND RELATED ART

The present invention relates to an image forming apparatus such as an electrophotographic copying machine and a laser beam printer, more particularly to an image forming apparatus wherein an image is formed on a movable image bearing surface by image forming means including means for charging the surface of the image bearing member, and wherein the surface of the image bearing member is cleaned by cleaning means and is used for repetitive image formation.

As an example of an image forming apparatus of such a type, there is an electrophotographic copying machine or an electrostatic recording apparatus of an image transfer type.

In an electrophotographic copying apparatus of the image transfer type, an electrophotographic photosensitive member in the form of a drum or an endless belt which is rotated is used as the image bearing member. On the surface of the photosensitive member a visualized image is formed by image forming means through a process including essentially uniform charging, an image exposure and a development, and the visualized image is transferred onto a surface of a transfer material by image transfer means. The transferred image is fixed on the surface of the transfer material by an image fixing means. The transfer material is discharged as a print on which an image has been formed. The surface of the photosensitive member, after the image has been transferred therefrom, is cleaned by cleaning means and is repeatedly used for image formation.

The electrostatic recording apparatus of the image transfer type uses a dielectric member in the form of a drum or an endless belt which is rotated as the image bearing member. A visualized image is formed on the surface of the dielectric member by image forming means through a process including essentially uniform, selective discharge and development. Similarly to the electrophotographic copying apparatus, the visualized image is transferred onto the surface of the transfer material and is fixed thereon. The transfer material is discharged as a print having an image. The surface of the dielectric member, after the image is transferred therefrom, is cleaned by a cleaning means for repetitive use for image formation.

The cleaning means removes untransferred, or residual, developer (toner), paper dust produced from the transfer material and other deposited foreign matter which remain on the surface of the photosensitive member or the dielectric member after the image is transferred onto the surface of the transfer material. Generally the cleaning means includes an elastic member such as urethane rubber which contacts the surface of the image bearing member to remove the foreign matter.

As for the means for uniformly charging the surface of the photosensitive member or the dielectric member, a corona discharger such as a corotron and a scorotron provided with a wire electrode and a shield electrode is widely used since it is good in uniformness of charging.

However, the corona discharger involves various problems. First, it requires an expensive high voltage source, a large space due to the structure of itself and the shielding space for the high voltage source. Also, it produces a relatively large amount of corona production such as ozone, and therefore, it requires additional means and mechanism for dealing with the production, which results in bulkiness and expensiveness of the apparatus.

Recently, therefore, it is considered to use a contact type charging device in place of the corona discharger involving the above problems. The contact type charging device includes a conductive member (contactable charging member) which is supplied from a power source with a voltage which is a DC voltage of approximately 1–2 KV, for example, or an superimposed DC and AC voltage, and contacts the image bearing member surface which is a member to be charged, by which the image bearing member is charged to a predetermined potential. As for the contact type charger, there is a roller type charger (U.S. Pat. No. 4,387,980), a blade type charger, a brush type charger and a charging and cleaning device (Japanese Laid-Open Patent Application 165,166/1981).

In the contact type charging system, it is important that the charging member contacts to the image bearing member uniformly along the length thereof, and if the contact is not uniform, the image bearing member surface is non-uniformly charged.

In the charging and cleaning device which functions for the charging and the cleaning, the non-uniform charging can occur due to the developer, the paper dust and other foreign matter which are removed from the surface of the image bearing member after the image transfer and which are accumulated in the charging portion. Particularly when the image forming apparatus is of a type wherein a dismountable process cartridge is used, foreign matter is sometimes introduced into the charging region by vibration produced upon mounting and dismounting operation of the process cartridge and produced when the process cartridge is carried around. On the other hand, from the standpoint of the cost, the blade type charger is preferable as disclosed in Japanese Laid-Open Patent Application 150,975/1983 and U.S. Pat. No. 4,387,980.

However, the blade type charging member can involve a problem that the surface of the image bearing member is worn or damaged or that the charging member or the cleaning member is burred, with the result of non-uniform charge.

SUMMARY OF THE INVENTION

Accordingly, it is a principal object of the present invention to provide an image forming apparatus including a contact type charger for charging a surface of an image bearing member, and wherein the surface of the image bearing member can be uniformly charged.

It is another object of the present invention to provide an image forming apparatus wherein a good image can be produced by uniformly charging the surface of the image bearing member.

According to an embodiment of the present invention, the contact between the image bearing member surface and the contact type charging member are uniformly contacted along the length thereof to uniformly charge the image bearing member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 8A and 8B illustrate models of the charging region using the Paschen's law.

FIGS. 9A, 9B and 9C illustrate examples of blade support.

FIG. 10 illustrates contact angles of the cleaning and charging blades.

DETAILED DESCRIPTION OF THE PREFERRED EMBODIMENTS

Figure 1:
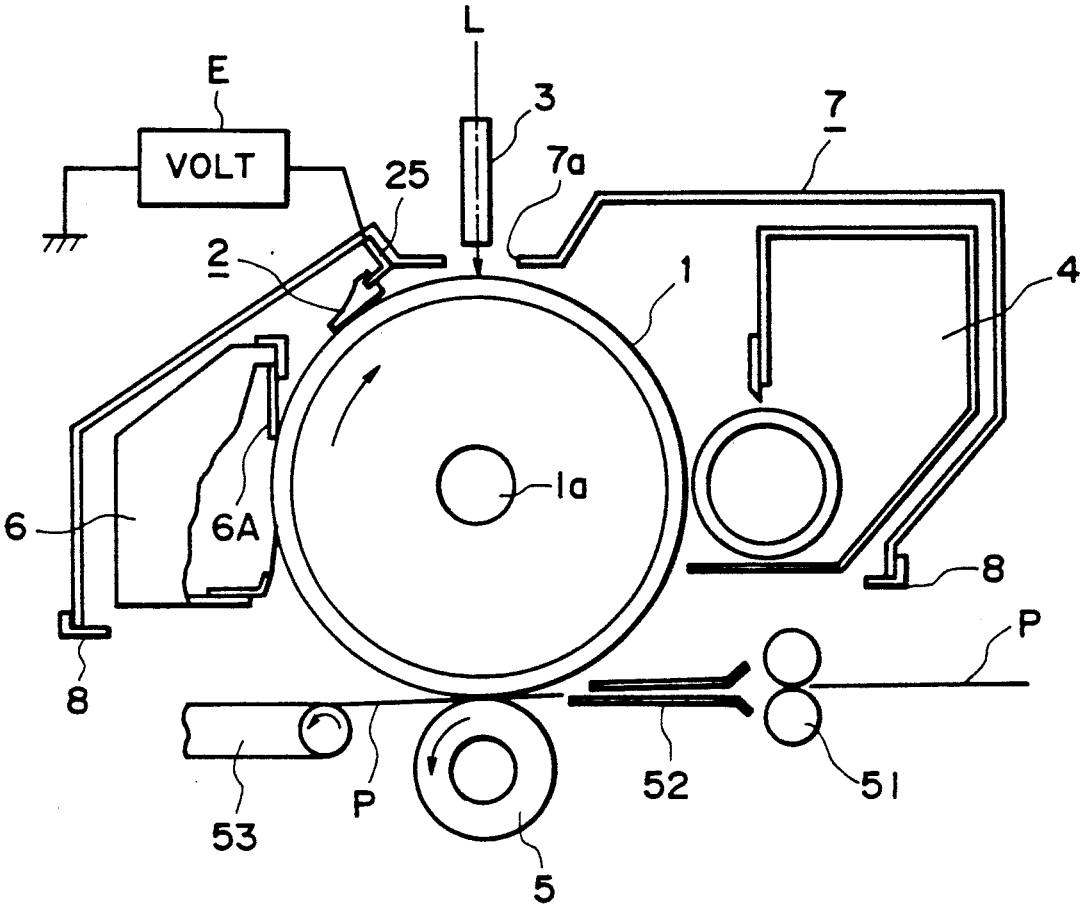
FIG. 1 somewhat schematically shows a general arrangement of an image forming apparatus according to an embodiment of the present invention.

Referring to FIG. 1, there is shown an image forming apparatus according to an embodiment of the present invention, wherein the image forming apparatus is illustrated as an image transfer type electrophotographic copying apparatus which is used with a process cartridge.

As shown in this Figure, the image forming apparatus comprises an electrophotographic photosensitive member in the form of a drum, which will hereinafter be called "photosensitive member". The photosensitive member 1 functions as an image bearing member and is driven to rotate at a predetermined peripheral speed in the direction indicated by an arrow about a shaft 1*a*. A contact type charging member 2 for uniformly charging a peripheral surface of the photosensitive member 1 is made of an electrically conductive elastic blade such as a conductive rubber blade which may be provided at its outer surface with a resistance layer having an appropriate resistance (a volume resistivity of $10^8$–$10^{12}$ ohm·cm, for example). The image forming apparatus comprises an array of short focus lenses as light image exposure means, a developing device 4, an image transfer device 5, a timing roller 51 for introducing a transfer material P fed one by one from an unshown feeding station into the clearance between the photosensitive member 1 and the transfer device 5 in synchronization with the rotation of the photosensitive member 1, and a transfer material guiding member 52 disposed between the timing roller 51 and the transfer device 5. The apparatus further comprises a conveying device 53 for conveying into an image fixing device not shown, the transfer material P having received an image passing through the clearance between the photosensitive member 1 and the transfer device 5, and a cleaning device 6 for cleaning the surface of the photosensitive member 1 after the image is transferred.

In the image forming apparatus of this embodiment, the photosensitive member 1, the contact charging member 2, the developing device 4 and the cleaning device 6 comprise a process cartridge 7 wherein they are built in in predetermined positional relationships. The process cartridge 7 may contain at least the contact type charging member 2 and the cleaning device 6. The process cartridge 7 is inserted into the main assembly of the copying apparatus along supporting rails 8 in the direction perpendicular to the sheet of the drawing of FIG. 1, or may be retracted out of the main apparatus.

By inserting the process cartridge 7 sufficiently into the main assembly, the process cartridge 7 and the main assembly of the copying apparatus are mechanically and electrically coupled to become operative as a copying system.

During one rotation, the peripheral surface of the photosensitive member 1 is uniformly charged by the blade 2 functioning as a contact charging member supplied with a voltage (a superposed DC and AC voltage, for example) from a power source E, and then is subjected to image light (slit exposure to an original image) when passing by the light image exposure means 3, by which an electrostatic latent image is sequentially formed thereon, corresponding to the pattern of the exposure. Designated by a reference 7*a* is a light passing opening formed in a cartridge housing wall in opposition to the light image exposure means 3. The light image exposure may be performed with the use of a scanning laser beam. In the case of an electrostatic recording, a latent image is sequentially formed on the image bearing member by means such as an array of electrodes for selectively discharging the image bearing member.

The latent image formed on the surface of the photosensitive member is sequentially developed or visualized as a toner image sequentially by the developing device 4. On the other hand, the transfer material P is singled out of an unshown sheet feeding station and is fed into the clearance between the transfer device 5 and the photosensitive member 1 in timed relation with the rotation of the photosensitive member 1 by the timing roller 51. The visualized image on the photosensitive member 1 is transferred onto a surface of the transfer material P.

The transfer material P having received the image by passing through the transfer station 5 is sequentially separated from the surface of the photosensitive member 1 and is transported by a conveying device 53 to an unshown image fixing device, where the image is fixed on the transfer material P, and it is discharged as a print.

On the other hand, the surface of the photosensitive member 1, after the image is transferred, is cleaned by a cleaning member 6A of the cleaning device 6, so that the residual toner thereon, the paper dust produced from the transfer material and other foreign matter are removed so as to be prepared for next image forming operation.

The cleaning member 6A in this embodiment includes a scraper blade, which will hereinafter be called "cleaning blade", made of urethane rubber or the like, contacting to the surface of the photosensitive member 1 at its edge. The cleaning blade 6A functions to scrape the residual matter off the surface of the photosensitive member 1.

Particularly when the surface of the photosensitive member 1 is made of resin such as OPC (organic photoconductor), the contact friction force in relation to the photosensitive member 1 is large, so that the cleaning blade 6A receives a strong burring force (a force tending to turn up the edge of the cleaning blade) so that the edge of the blade is easily burred. Actually, however, the residual matter such as the developer removed from the photosensitive member 1 surface is present at the contact area between the cleaning blade 6A and the photosensitive member 1 and functions as a lubricant to reduce the dynamic friction coefficient to prevent the blade from burring.

However, the contact charging blade 2 is contacted to the surface of the photosensitive member 1 which has been cleaned by the cleaning blade 6A, and therefore, the lubricating function of the residual matter as in the case of the cleaning blade 6A is not provided, so that the blade is in the state of being easily burred.

Figure 3A:
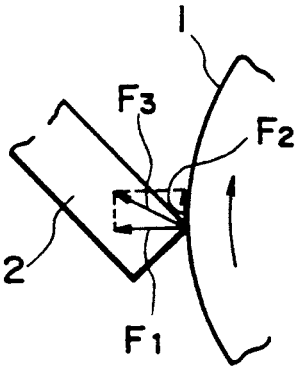
FIGS. 3A and 3B illustrate forces relating to burr of the blade.
Figure 3B:
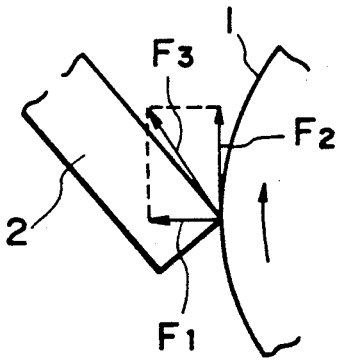

FIG. 3B shows the relation among the burring forces, wherein F1 is a force necessary for pressing the contact charging blade to the photosensitive member 1 surface for uniform charging, F2 is a frictional force resulting from the pressing force of the contact charging blade 2 to the photosensitive member 1 when the surface of the photosensitive member is moved, and F3 is a resultant force thereof. The friction force F2 is $\mu$F1, where the friction coefficient is $\mu$. In the conventional device, the resultant force F3 is such as to burr the edge of the blade 2, and the force F2 increases with increase of the friction coefficient, so that the burring force increases.

The frictional coefficient of that portion of the contact charging blade 2 which contacts the photosensitive member 1 is reduced down to the dynamic frictional coefficient at the contact portion between the cleaning blade 6A and the photosensitive member 1 under the existence of the residual matter such as the developer, so that as shown in FIG. 3A, the resultant force F3 extends into the mass of the blade, by which the burring component decreases to ease the blade compression to prevent the burring of the blade.

Figure 2A:
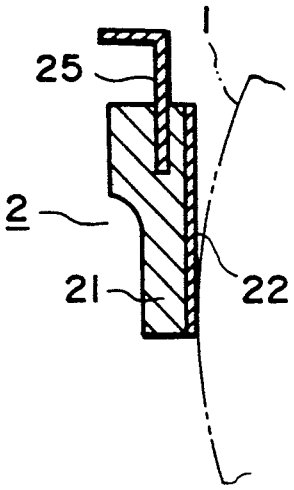
FIGS. 2A, 2B and 2C are sectional views of examples of contact type charging blade which have been subjected to a friction coefficient reducing treatment.
Figure 2B:
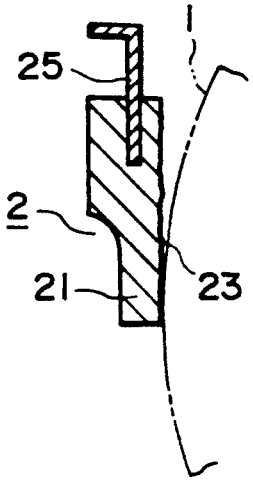
Figure 2C:
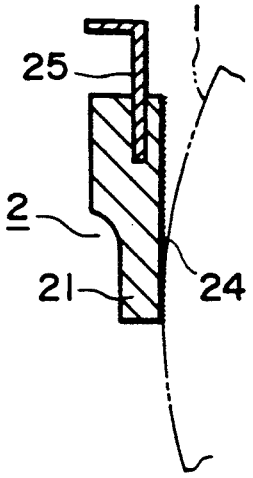

Referring to FIGS. 2A, 2B and 2C, there are shown examples of structures for reducing the frictional coefficient of the blade 2 relative to the photosensitive member 1.

EXAMPLE 1 (FIG. 2A)

The contact charging blade 2 is provided with a conductive rubber blade portion 21 in which the resistance is controlled. The voltage is applied to the blade portion 21 through the conductive support 25. In this example, that side of the blade portion 21 which faces the photosensitive member 1 is provided with a sheet layer 22, attached thereto, which is made of a low friction coefficient material and which has better parting properties than rubber. The sheet layer 22 is made, in this example, of a resin such as nylon or PFA resin having good lubricating properties, containing electrically conductive material to control electric resistance. By the sheet layer 22, the frictional coefficient of the contact charging blade 2 is reduced.

Where the resistance of the sheet layer 22 is controlled so that the current leakage is prevented during the charging operation, the blade portion 21 may have a low resistance. However, when the thickness of the sheet layer 22 is large, the charging performance is not good, and therefore, the thickness of the sheet layer 22 is preferably as small as possible.

EXAMPLE 2 (FIG. 2B)

In this example, the conductive rubber blade portion 21 which is the main body is molded. The molding surface is finely roughened so that the surface of the blade portion 21 facing to the photosensitive member has a finely roughened surface 23, by which the effective contact area between the photosensitive member and the blade portion 21 is reduced to reduce the frictional coefficient.

EXAMPLE 3 (FIG. 2C)

In this example, the conductive rubber blade portion 21 which is the main body is molded. Usually, a parting agent remains on the surface of the molded blade. The parting agent has been applied on the molding surface during the molding process, and is silicone or fluorine oil type parting agent. The parting agent on that surface of the blade portion which faces the photosensitive member, at least, is not removed and remains, as shown by the reference numeral 24. The lubricating property of the parting agent is utilized to reduce the frictional coefficient of the blade with respect to the photosensitive member.

In the foregoing embodiment, the peak-to-peak voltage of a vibratory voltage applied to the charging blade is preferably not less than twice the absolute value of the charging starting voltage when only a DC voltage is applied as disclosed in U.S. Ser. No. 478,035, filed Feb. 9, 1990. Here, the vibratory voltage is a voltage which periodically changes with time, and the waveform may be sine, triangular, rectangular or the like form.

Figure 4:
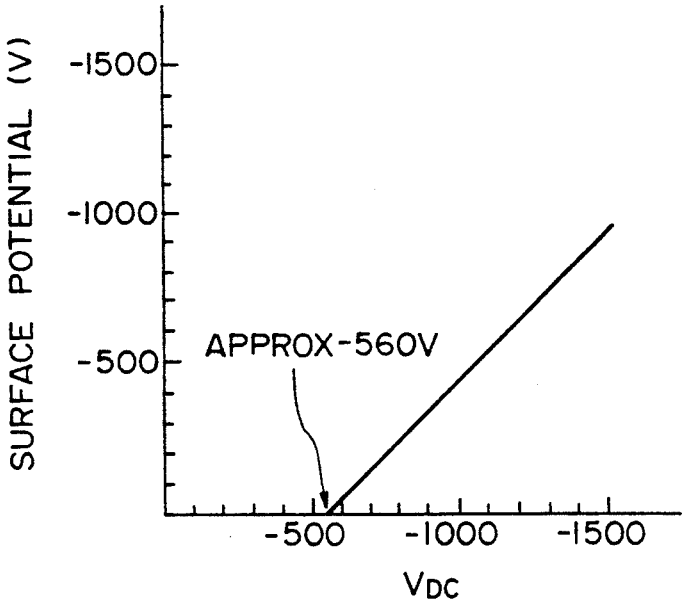
FIG. 4 is a graph showing a relation between a DC voltage applied to the contact charging blade and a surface potential of a photosensitive drum (OPC).

The charge starting voltage is determined in the following manner. The charging member contacts a member to be charged having a surface potential of 8 zero, and only a DC voltage is applied to the charging member. The DC voltage is increased, and the surface potential of the member to be charged is plotted in the surface potential vs. applied voltage graph. The voltages are plotted in increments of 100 V. The first plot of the voltage is the one which the surface potential of the member to be charged appears, and ten surface potentials are plotted at each 100 V increment. Using least square approximation, a straight line is drawn from the plots. The DC voltage leading at which the straight line and the line representing the zero surface potential crosses is deemed as the charge starting voltage. FIG. 4 is a graph illustrating an example of the above method. The charge starting voltage was −560 V in this embodiment. By setting the peak-to-peak voltage of the vibratory voltage applied to the contact charging member to be not less than twice the absolute value of the charge starting voltage to the member to be charged, as defined above, the nonuniformness of the charging does not occur, and therefore, the uniform charging can be provided.

Figure 5:
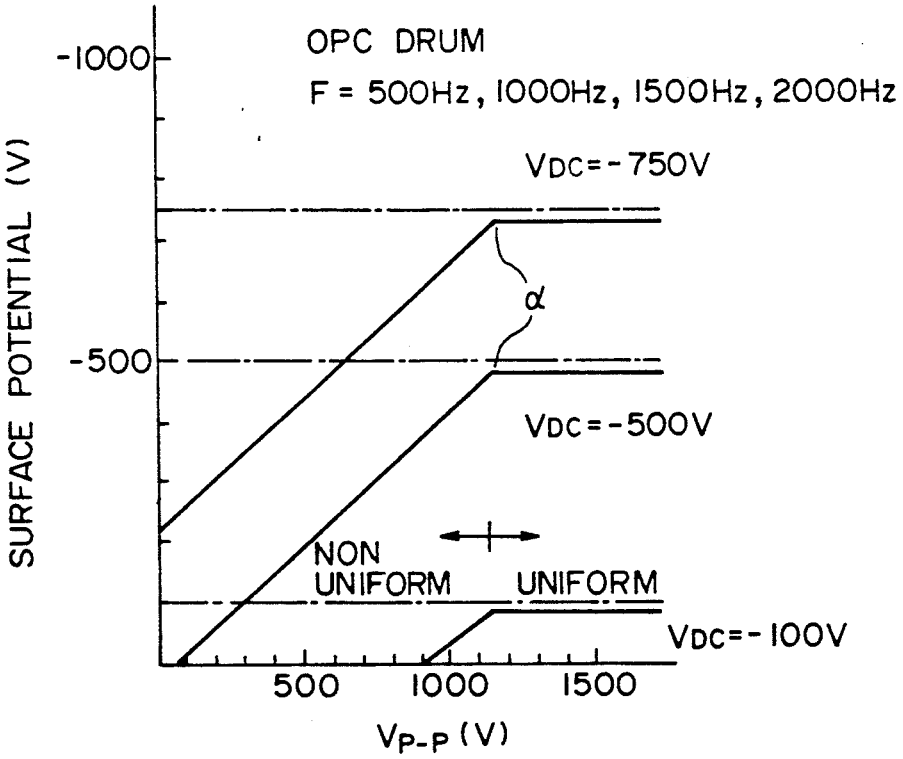
FIG. 5 is a graph showing a relation between a peak-to-peak voltage of a vibratory voltage applied to the contact charging blade and a surface potential of an OPC photosensitive drum.
Figure 6:
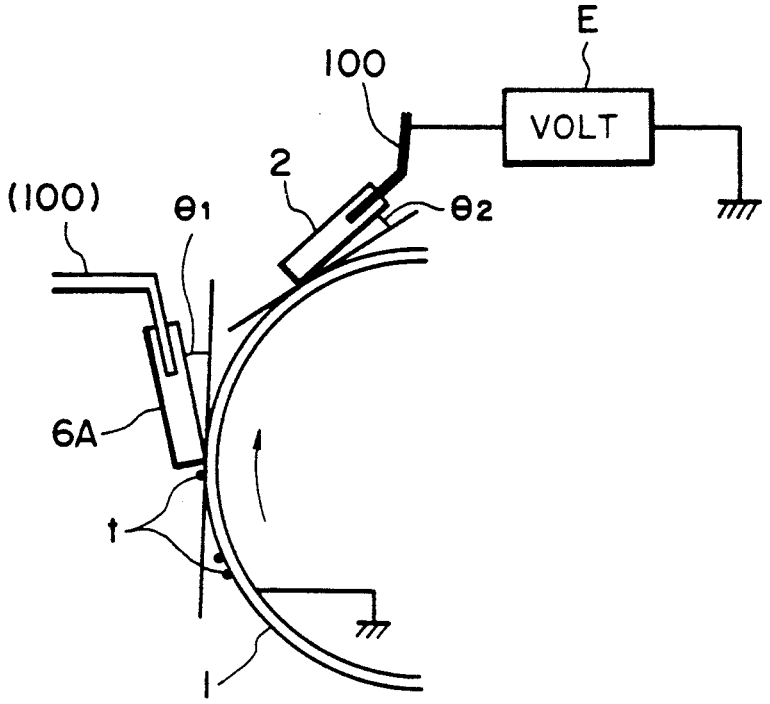
FIG. 6 is an enlarged view of a cleaning blade and a contact charging blade.

FIG. 5 is a graph showing a relation between the peak-to-peak voltage of the vibratory voltage applied to the charging member and a surface potential of an OPC photosensitive drum, where the applied DC voltage $V_{DC}$= −750, −500, −100 V. When the peak-to-peak voltage of the vibratory voltage is gradually increased to such an extent that it is twice the absolute value (560 V) of the charge starting voltage, the surface potential of the photosensitive member becomes a predetermined level with uniformness over the surface of the photosensitive member.

Durability tests were performed. The photosensitive member 1 was an OPC photosensitive member. The cleaning blade 6A was made of a urethane rubber (65 degrees JIS A). The cleaning blade 6A was press contacted to the photosensitive member 1 under a pressure of 11–35 g/cm. The contact charging blade 2 included a conductive EPDM rubber blade 21 having the volume resistivity of $10^2$–$10^6$ ohm·cm and a lubricating coating layer 22 made of a nylon resin having the volume resistivity of $10^8$ ohm·cm. The charging blade was press contacted to the photosensitive member under the pressure of 5–20 g/cm. The blade 2 was supplied with a bias voltage which is a vibratory voltage provided by superposing a DC voltage of 700 V and an AC voltage having a peak-to-peak voltage Vpp of 1500 V and a frequency of 800 Hz. The surface potential provided on the photosensitive member was approximately 700 V.

Without the lubricating coating layer 22 on the contact charging blade 2, the blade was burred, or the photosensitive member was damaged after 1000 sheets were processed. On the contrary, with the lubricating coating layer 22, the blade was not burred, and the photosensitive member is not damaged even after 3000 sheets were processed.

Various experiments have revealed that in order to further improve the cleaning properties and charging properties for the image bearing member, it is preferable that the contact angle of the charging blade relative to the image bearing member is smaller than the contact angle of the cleaning blade relative to the image bearing member. Here, the contact angle of the blade relative to the image bearing member is defined as an angle formed between a tangent line of the image bearing member at the point of contact between the blade and the image bearing member and a line extending between an edge contact point of the blade to the image bearing member and a point 2 mm away from the edge contact point along the surface of the blade toward a blade support.

FIG. 10 illustrates the contact angle as defined above. The description will be made as to the relation between the contact angle of the charging blade relative to the image bearing member and the contact angle of the cleaning blade relative to the image bearing member. The cleaning blade 6A is imparted by a pressure necessary for removing the residual matter t (FIG. 2) from the surface of the photosensitive member 1. The contact angle 01 of the cleaning blade 6A relative to the photosensitive member 1 is formed at the downstream side of the contact between the cleaning blade and the photosensitive member with respect to the moving direction of the photosensitive member surface, and is such that the cleaning blade surface is not contacted to the photosensitive member at its an antinoding side. The contacting edge of the cleaning blade 6A tends to turn up, that is, to burr toward the movement of the photosensitive member 1 surface by the friction with the photosensitive member 1, and the tendency is stronger with increase of the angle $\theta 1$. Actually, however, even if the angle $\theta 1$ is relatively large, the residual matter t removed from the surface of the photosensitive member 1 is present in the area of contact between the cleaning blade 6A and the photosensitive member 1, and the residual matter functions as a lubricant to reduce the dynamic frictional coefficient to prevent the cleaning blade 6A from burring. In other words, the permissible range of the contact angle $\theta 1$ is enlarged.

The contact angle $\theta 2$ of the contact charging blade 2 relative to the photosensitive member, which is smaller than 90 degrees, is formed a side downstream of the point of contact therebetween with respect to the movement direction of the surface of the photosensitive member. In other words, the cleaning blade 6 and the charging blade 2 are counter-directionally disposed relative to the photosensitive member.

For the charging blade 2, as contrasted to the cleaning blade 6A, there is no residual matter functioning as the lubricant, at the point of contact between the charging blade 2 and the photosensitive member 1 surface. For this reason, the blade is more easily burred, and it depends on the contact angle $\theta 2$ of the blade 2 relative to the photosensitive member 1.

Figure 7A:
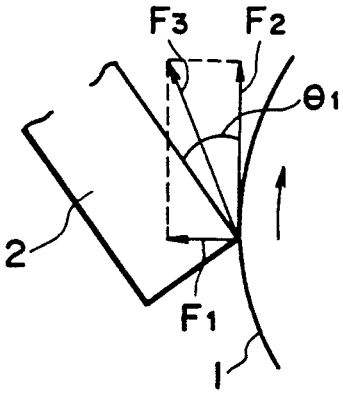
FIGS. 7A and 7B illustrate forces relating to the burr of the blade.
Figure 7B:
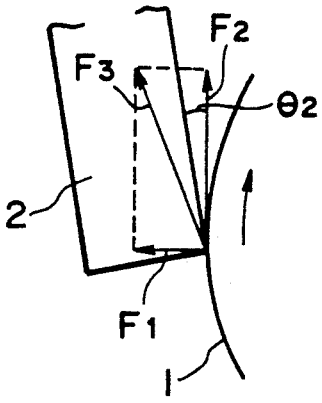

As will be understood from FIG. 7, the blade 2 contacting to the rotational photosensitive member 1 receives a force F3 which is a resultant force of a pressing force F1 and a frictional force F2. Where the direction of the resultant force F3 is within the contact angle 01 as shown in FIG. 7A, it imparts a rotational external force as indicated by an arrow in this Figure to promote the burring of the blade. On the other hand, where the resultant force F3 is directed outside the angle 02, that is, into the mass of the blade, as shown in FIG. 7B, the resultant force F3 is effective to compress the blade, but is not a rotational force, and therefore, it is difficult for the blade edge to burr.

As will be understood from the above, it is desirable that the contact angle 02 of the charging blade 2 relative to the photosensitive member is as small as possible. The small contact angle 02 is also effective to make the charging uniform.

This will be explained more in detail. When the blade 2 is supplied with a DC voltage DC from a power source E, the electric charge is applied to the photosensitive member (image bearing member) adjacent the wedge-shaped small clearance $d_1$ formed between the blade 2 and the photosensitive member 1 in accordance with Paschen's law In this case, only a DC voltage is applied, the charging easily becomes non-uniform, irrespective of the contact angle being $\theta 2$ (FIG. 8A) or $\theta 2'$ (FIG. 8B) However, if a vibratory bias voltage which is provided by superposing a DC voltage and an AC voltage is applied to the blade 2, and if the AC voltage component has a peak-to-peak value which is not less than twice the charge starting voltage, the charging is uniform.

If this is done, the application of the AC voltage is contributable to expand the Paschen's region, that is, the expansion of the charging region. The regions are shown by $d_1$–$d_2$ (hatched portion) in FIGS. 8A and 8B. As will be understood from FIGS. 8A and 8B, there occurs a difference between the case of angle of $\theta 2$ and the angle of $\theta 2'$. In FIG. 8A (angle$=\theta 2$), in order to increase the region 1 to the region 1' (FIG. 8B) in an attempt to obtain the uniform charging property, the peak-to-peak voltage has to be increased, with the result that the capacity of the power source E has to be increased, by which the break-down of the power source and the leakage of current to the photosensitive member can occur. Therefore, decreasing the angle $\theta 2$ to $\theta 2'$ is advantageous also from the standpoint of the charging property.

As described above, the contact angle $\theta 2$ of the contact charging blade 2 relative to the photosensitive member is smaller than the contact angle $\theta 1$ of the cleaning blade relative to the photosensitive member ($\theta 2 < \theta 1$), by which the cleaning blade 6A is not contacted to the photosensitive member 1 at its antinoding side to ensure good cleaning properties, and simultaneously, the contact charging blade is not burred with the uniform and stabilized charging property ensured. On the contrary, when the contact angle $\theta 2$ is not less than the contact angle $\theta 1$ ($\theta 2 \geqq \theta 1$), the contact charging blade 2 is more easily burred with increase of the contact angle $\theta 2$ beyond the contact angle $\theta 1$, and the uniform charging is not provided to a practicable extent.

The charging properties and the cleaning properties were investigated through experiments. The charging blade and the cleaning blade were made of polyester urethane rubber having a hardness of 65 degrees (JIS A), and they each had a thickness of 2 mm and free portion length of 10 mm. The contact angle to the photosensitive member was changed. The results are shown in the following tables.

TABLE 1

CHARGING BLADE CONTACT ANGLE VS. CHARGING PROPERTY

| $\theta 2$ | 0 | 5 | 10 | 15 | 20 | 25 | 30 |
|---|---|---|---|---|---|---|---|
| CHARGING PROPERTY | G | G | G | G | F | N | N |

TABLE 2

CLEANING BLADE CONTACT ANGLE VS. CLEANING PROPERTY (OPC PHOTOSENSITIVE MEMBER)

| $\theta 1$ | 10 | 15 | 20 | 25 | 30 | 35 | 40 | 45 | 50 |
|---|---|---|---|---|---|---|---|---|---|
| CLEANING PROPERTY | N | F | G | G | G | F | N | N | N |

TABLE 3

CLEANING BLADE CONTACT ANGLE VS. CLEANING PROPERTY (A-Si PHOTOSENSITIVE MEMBER)

| $\theta 1$ | 10 | 15 | 20 | 25 | 30 | 35 | 40 | 45 | 50 |
|---|---|---|---|---|---|---|---|---|---|
| CLEANING PROPERTY | N | F | G | G | G | G | F | N | N |

In these experiments, the blades were counterdirectionally contacted with respect to the moving direction of the surface of the photosensitive member.

The charging properties and the cleaning properties are evaluated on the basis of the final image when they were incorporated in an electrophotographic copying machine. In the Table, "G" indicates that the charging properties and the cleaning properties are good, and the final image is good enough; "F" indicates that the final image involves a little problem arising from the charging properties and the cleaning properties, but it is practically good; and "N" indicates that the final image involves problems arising from the charging properties and the cleaning properties, and it is not practically usable. The charging properties are "N" when the final image includes spots, while the cleaning properties are "N" when a stripe or stripes are produced on the image in the direction of the photosensitive member movement. These are easily observed when a solid black image is formed, in the case of a regular development. The charging and cleaning properties are deemed "G" when good images are provided even after 3000 copies are produced. The charging properties were not influenced by materials of the photosensitive member.

The experiments were conducted in the following steps. At first, the contact angle of the charging blade $\theta 2$ was fixed 0 degrees, whereas the contact angle $\theta 1$ of the cleaning blade is changed in the range of 10–50 degrees, and the charging and cleaning properties were investigated. Next, the contact angle $\theta 2$ was increased in increments of 5 degrees, and the contact angle $\theta 1$ was changed in the range of 10–50 degrees for each incremented angle, and the charging and cleaning properties were investigated. It was confirmed that the charging blade is practically usable when the contact angle $\theta 2$ thereof is not less than 20 degrees, but it is not practically usable due to the insufficient charging properties if it is not less than 25 degrees.

It is possible that the cleaning operation by the cleaning blade 6A disposed upstream of the contact charging blade 2 with respect to the movement direction of the surface of the photosensitive member becomes insufficient for one reason or another with the result that the residual matter reaches the contact charging blade 2. Even if this occurs, the contact charging blade 2 can function as an additional cleaning blade, since it is counter-directionally contacted to the surface of the photosensitive member, so that the residual matter is prevented from entering the charging region by the contact charging blade 2 to the photosensitive member, so that the good charging properties can be maintained with the advantage of ensuring the cleaning of the photosensitive member surface. However, if the cleaning blade is effective to substantially completely remove the residual matter from the photosensitive member 1, and there is no residual matter at the contact portion between the charging blade and the photosensitive member, the charging blade 2 may contact the photosensitive member co-directionally with the movement direction of the photosensitive member surface. In this case, the contact angle of the charging blade relative to the photosensitive member, which is smaller than 90 degrees is formed at the upstream side of the contact portion between the photosensitive member 1 and the charging blade 2 with respect to the movement direction of the photosensitive member surface. The cleaning blade is not limited to the one counter-directionally contacted to the photosensitive member, but it may be co-directionally contacted.

Making the frictional coefficient of the charging blade relative to the photosensitive member smaller than that of the cleaning blade is effective from the standpoint of the problems of wearing of the blade or the photosensitive member and the scraping thereof, irrespective of the direction of the contact of the charging blade and the cleaning blade.

Since the charging blade and the cleaning blade are integrally supported and covered by the process cartridge, and therefore, the charging operation is prevented from being influenced by the dust or foreign matter which otherwise is deposited on the photosensitive member after the photosensitive member is cleaned by the cleaning blade.

If the frictional coefficient of the cleaning blade is equal to or smaller than the frictional coefficient of the charging blade, the durability of the charging blade is smaller than that of the cleaning blade However, by making the frictional coefficient of the charging blade smaller than that of the cleaning blade, the durability of the charging blade can be made substantially equal to that of the cleaning blade. This is preferable, since both of the blades are provided in a cartridge detachably mountable into a main assembly, the cartridge may be exchanged with a new one when both of the blades come to the respective ends of the service lives which are substantially equal. Further, when an image bearing member is disposed in the cartridge, the service lives of blades are preferably equivalent to that of the image bearing member.

FIGS. 9A, 9B and 9C show various examples of supports of the contact charging blade 2 (or the cleaning blade 6A) by supporting members 100. FIG. 9A shows an example wherein the blade is sandwiched by supporting members 100; FIG. 9B shows an example wherein the blade is bonded to the support; and FIG. 9C shows an example wherein the blade is integrally supported by molding or by metal member.

As described in the foregoing, according to the present invention, the frictional coefficient of the contact charging member to the image bearing member is smaller than that of the cleaning member, by which the damage or wearing of the image bearing member or the charging member is not significant, the state of contact can be stabilized, so that the charging action is also stabilized to provide a good image.

In addition, the service lives of the contact charging member and the cleaning member can be made substantially equal, and this is particularly advantageous when a process cartridge contains both of the blades.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member for carrying a toner image;

a cleaning member in the form of a blade for contacting said image bearing member to clean said image bearing member by removing residual toner therefrom, wherein a contact portion of said cleaning member has a first frictional coefficient;

a charging member in the form of a blade for charging said image bearing member, said charging member contacting said image bearing member at a position downstream of said cleaning member with respect to a moving direction of said image bearing member, wherein a contacting pressure of said charging member on said image bearing member is 5–20 g/cm, and wherein a contact portion of said charging member has a second frictional coefficient which is smaller than the first frictional coefficient; and voltage application means for applying a voltage to said charging member.

2. Apparatus according to claim 1, wherein said charging member contacts said image bearing member at a first contact angle, and said cleaning member contacts said image bearing member at a second contact angle wherein the first contact angle is smaller than the second contact angle.

3. An apparatus according to claim 2, wherein the first contact formed downstream of a position where said charging member contacts said image bearing member with respect to a moving direction of said image bearing member.

4. An apparatus according to claim 3, wherein the second contact angle is formed downstream of a position where said cleaning member contacts said image bearing member a moving direction of said image bearing member.

5. An apparatus according to claim 2, wherein the contact angle of said charging member relative to said image bearing member is not more than 20 degrees.

6. An apparatus according to claim 1, wherein said voltage application means applies a vibratory voltage to said charging member.

7. An apparatus according to claim 6, wherein said vibratory voltage is provided by superposing a DC voltage and an AC voltage.

8. An apparatus according to claim 6, wherein the vibratory voltage has a peak-to-peak voltage which is not less than twice an absolute value of a charge starting voltage to said image bearing member.

9. An apparatus according to claim 1, wherein said charging member is of rubber.

10. An apparatus according to claim 1, wherein said charging member includes a low frictional coefficient layer of resin material contactable to said image bearing member.

11. An apparatus according to claim 10, wherein said resin layer is nylon resin.

12. An apparatus according to claim 1, wherein said charging member has a resin layer at a portion contacting said image bearing member.

13. An apparatus according to claim 12, wherein said resin layer is nylon resin.

14. An image forming apparatus, comprising:

a movable image bearing member for carrying a toner image;

a cleaning member in the form of blade for contacting said image bearing member to clean said image bearing member by removing residual toner therefrom, wherein a contact portion of said cleaning member has a first frictional coefficient;

a charging member is the form of a blade for charging said image bearing member, said charging member contacting said image bearing member at a position downstream of said cleaning member with respect to a moving direction of said image bearing member, wherein a contacting pressure of said charging member on said image bearing member is 5–20 g/cm, and wherein a contact portion of said charging member has a second frictional coefficient which is smaller than the first frictional coefficient;

voltage application means for applying a voltage to said charging member; and supporting means for supporting said charging member and said cleaning member, said supporting means being detachably mountable to said image forming apparats.

15. An apparatus according to claim 14, wherein said charging member contacts said image bearing member at a first contact angle, and said cleaning member contacts said image bearing member at a second contact angle wherein the first contact angle is smaller than the second contact angle.

16. An apparatus according to claim 15, wherein the first contact angle is formed downstream of a position where said cleaning member contacts said image bearing member with respect to a moving direction of said image bearing member.

17. An apparatus according to claim 16, wherein the second contact angle is formed downstream of a position where said cleaning member contacts said image bearing member with respect to a moving direction of said image bearing member.

18. An apparatus according to claim 15, wherein the contact angle of said charging member relative to said image bearing member is not more than 20 degrees.

19. An apparatus according to claim 14, wherein said voltage application means applies to vibratory voltage to said charging member.

20. An apparatus according to claim 19, wherein said vibratory voltage is provided by superposing a DC voltage and an AC voltage.

21. An apparatus according to claim 19, wherein the vibratory voltage has a peak-to-peak voltage which is not less than twice an absolute value of a charge starting voltage to said image bearing member.

22. An apparatus according to claim 14, wherein said charging member is of rubber.

23. An apparatus according to claim 14, wherein said charging member includes a low frictional coefficient layer of resin material contactable to said image bearing member.

24. An apparatus according to claim 23, wherein said resin layer is nylon resin.

25. An apparatus according to claim 14, wherein said supporting means includes a process cartridge detachably mountable to said image forming apparatus.

26. An apparatus according to claim 14, wherein said charging member has a resin layer at a portion contacting said image bearing member.

27. An apparatus according to claim 26, wherein said resin layer is nylon resin.

28. An apparatus according to claim 14, wherein said supporting means further comprises an image bearing member.

29. A process cartridge detachably mountable into a main assembly of an image forming apparatus, comprising:

a movable image bearing member for carrying a toner image;

a cleaning member in the form of a blade for contacting said image bearing member to clean said image bearing member by removing residual toner therefrom, wherein a contact portion of said cleaning member has a first frictional coefficient; and a charging member in the form of a blade for charging said image bearing member, said charging member contacting said image bearing member at a position downstream of said cleaning member with respect to a moving direction of said image bearing member, wherein a contacting pressure of said charging member on said image bearing member is 5–20 g/cm, and wherein a contact portion of said charging member has a second frictional coefficient which is smaller than the first frictional coefficient.

30. A cartridge according to claim 29, wherein said charging member contacts said image bearing member at a first contact angle, and said cleaning member contacts said image bearing member at a second contact angle wherein the first contact angle is smaller than the second contact angle.

31. A cartridge according to claim 30, wherein the first contact angle is formed downstream of a position where said charging member contacts said image bearing member with respect to a moving direction of said image bearing member.

32. A cartridge according to claim 30, wherein the second contact angle is formed downstream of a position where said cleaning member contacts said image bearing member with respect to a moving direction of said image bearing member.

33. A cartridge according to claim 30, wherein the contact angle of said charging member relative to said image bearing member is not more than 20 degrees.

34. A cartridge according to claim 29, wherein said charging member is of rubber.

35. A cartridge according to claim 29, wherein said charging member includes a low frictional coefficient layer of resin material contactable to said image bearing member.

36. A cartridge according to claim 35, wherein said resin layer is nylon resin.

37. A cartridge according to claim 29, wherein said charging member has a resin layer at a portion contacting said image bearing member.

38. A cartridge according to claim 37, wherein said resin layer is nylon resin.

39. An image forming apparatus, comprising:

a movable image bearing member for carrying a toner image, said image bearing member having an organic photoconductor layer on an outer surface thereof;

a cleaning member in the form of a blade for contacting said image bearing member to clean said image bearing member by removing residual toner therefrom, wherein a contact portion of said cleaning member has a first frictional coefficient;

a charging member in the form of a blade for charging said image bearing member, said charging member contacting said image bearing member, wherein a contacting pressure of said charging member on said image bearing member is 5–20 g/cm, and wherein a contact portion of said charging member has a second frictional coefficient which is smaller than the first frictional coefficient; and voltage application means for applying a voltage to said charging member.

40. An apparatus according to claim 39, wherein said charging member contacts said image bearing member at a first contact angle, and said cleaning member contacts said image bearing member at a second contact angle wherein the first contact angle is smaller than the second contact angle.

41. An apparatus according to claim 40, wherein the first contact angle is formed downstream of a position where said charging member contacts said image bearing member with respect to a moving direction of said image bearing member.

42. An apparatus according to claim 41, wherein the second contact angle is formed downstream of a position where said cleaning member contacts said image bearing member with respect to a moving direction of said image bearing member.

43. An apparatus according to claim 39, wherein said charging member includes a low frictional coefficient layer of resin material contactable to said image bearing member.

44. An apparatus according to claim 43, wherein said resin layer is nylon resin.

* * * * *

UNITED STATES PATENT AND TRADEMARK OFFICE

CERTIFICATE OF CORRECTION

PATENT NO. : 5,168,309

DATED : December 1, 1992

INVENTOR(S) : Hiroyuki ADACHI, et al.

It is certified that error appears in the above-identified patent and that said Letters Patent is hereby corrected as shown below:

COLUMN 1:

Line 8, "Sep. 20, 1988," should read --Sep. 30, 1988,--.

COLUMN 2:

Line 15, "an" should read --a--;

Line 25, "to" should be deleted.

COLUMN 4:

Line 26, "reference 7a" should read --reference numeral 7a--;

Line 62, "to" should be deleted.

COLUMN 6:

Line 6, "to" should be deleted;

Line 35, "8 zero," should read --zero,--;

Line 45, "leading" should read --reading--.

UNITED STATES PATENT AND TRADEMARK OFFICE

CERTIFICATE OF CORRECTION

PATENT NO. : 5,168,309 Page 2 of 3

DATED : December 1, 1992

INVENTOR(S) : Hiroyuki ADACHI, et al.

It is certified that error appears in the above-identified patent and that said Letters Patent is hereby corrected as shown below:

COLUMN 7:

Line 47, "angle 01" should read --angle θ1--;

Line 53, "an" should be deleted.

COLUMN 8:

Line 15, "to" should be deleted;

Line 18, "angle 01" should read --angle θ1--;

Line 22, "angle 02," should read --angle θ2,--;

Line 28, "angle 02" should read --angle θ2--;

Line 30, "angle 02" should read --angle θ2--;

Line 41, "(FIG. 8B)" should read --(FIG. 8B).--.

COLUMN 10:

Line 54, "and" should be deleted.

COLUMN 11:

Line 55, "Apparatus" should read --An apparatus--;

Line 62, "contact formed" should read --contact angle is formed--.

UNITED STATES PATENT AND TRADEMARK OFFICE

CERTIFICATE OF CORRECTION

PATENT NO. : 5,168,309 Page 3 of 3

DATED : December 1, 1992

INVENTOR(S) : Hiroyuki ADACHI, et al.

It is certified that error appears in the above-identified patent and that said Letters Patent is hereby corrected as shown below:

COLUMN 12:

Line 37, "is" should read --in--;

Line 52, "apparats." should read --apparatus.--.

COLUMN 13:

Line 5, "to" should read --a--.

Signed and Sealed this

Twenty-second Day of February, 1994

Attest:

Bruce Lehman

BRUCE LEHMAN

Attesting Officer

Commissioner of Patents and Trademarks